US008939094B2

(12) United States Patent
Martin et al.

(10) Patent No.: US 8,939,094 B2
(45) Date of Patent: Jan. 27, 2015

(54) INCINERATION PLANT AND METHOD FOR CONTROLLING AN INCINERATION PLANT

(75) Inventors: Johannes Martin, Munich (DE); Oliver Gohlke, Munich (DE)

(73) Assignee: Martin GmbH fuer Umwelt—und Energietechnik, Munich (DE)

( * ) Notice: Subject to any disclaimer, the term of this patent is extended or adjusted under 35 U.S.C. 154(b) by 843 days.

(21) Appl. No.: 12/455,115

(22) Filed: May 28, 2009

(65) Prior Publication Data

US 2009/0293787 A1 Dec. 3, 2009

(30) Foreign Application Priority Data

May 29, 2008 (RU) ..... 2008121732

(51) Int. Cl.

| | |
|---|---|
| ***F23G 5/00*** | (2006.01) |
| ***F23N 5/08*** | (2006.01) |
| ***F23J 1/06*** | (2006.01) |
| ***F23B 30/00*** | (2006.01) |
| ***F23B 70/00*** | (2006.01) |
| ***F23G 5/50*** | (2006.01) |
| ***F23N 1/02*** | (2006.01) |

(52) U.S. Cl.

CPC ..... *F23N 5/082* (2013.01); *F23B 5/025* (2013.01); *F23B 70/00* (2013.01); *F23G 5/50* (2013.01); *F23G 2202/106* (2013.01); *F23G 2205/10* (2013.01); *F23G 2207/20* (2013.01); *F23G 2900/00001* (2013.01); *F23G 2900/55006* (2013.01); *F23G 2900/55009* (2013.01); *F23N 1/022* (2013.01); *F23N 2021/12* (2013.01); *F23N 2023/36* (2013.01); *F23N 2023/54* (2013.01); *F23N 2041/18* (2013.01)

USPC ..... 110/259; 110/186; 110/346; 110/165 R

(58) Field of Classification Search

CPC ..... F23B 5/025; F23B 70/00; F23B 5/02; F23G 2202/106

USPC ..... 110/235, 248, 255, 259, 186, 346, 165 R

See application file for complete search history.

(56) References Cited

U.S. PATENT DOCUMENTS

| | | | | |
|---|---|---|---|---|
| 3,946,680 | A * | 3/1976 | Laman | 110/257 |
| 4,365,984 | A * | 12/1982 | Gee | 110/264 |
| 4,532,872 | A * | 8/1985 | Anderson | 110/255 |
| 4,742,783 | A * | 5/1988 | LaSpisa et al. | 110/188 |
| 4,765,256 | A * | 8/1988 | Caughey | 110/229 |

(Continued)

FOREIGN PATENT DOCUMENTS

| | | |
|---|---|---|
| DE | 101 31 464 A1 | 1/2003 |
| EP | 0 862 019 A1 | 9/1998 |

(Continued)

OTHER PUBLICATIONS

Office Action in Japanese Patent Application No. JP 2009-127590 dated Aug. 6, 2013.

*Primary Examiner* — David J Laux

(74) *Attorney, Agent, or Firm* — Collard & Roe, P.C.

(57) ABSTRACT

The invention relates to an incineration plant with a furnace, a device for feeding back incineration residues into the furnace, a device for measuring at least one parameter of the incineration, and devices for controlling the incineration. Moreover, the invention relates to a method for controlling an incineration plant.

11 Claims, 1 Drawing Sheet

(56) References Cited

U.S. PATENT DOCUMENTS

| | | | | |
|---|---|---|---|---|
| 4,986,199 | A * | 1/1991 | Komeno et al. | 110/347 |
| 6,199,492 | B1 * | 3/2001 | Kunstler | 110/342 |
| 7,040,240 | B2 * | 5/2006 | Goke et al. | 110/266 |
| 7,640,872 | B2 * | 1/2010 | Martin et al. | 110/342 |
| 2003/0065236 | A1 | 4/2003 | Vosteen et al. | |
| 2004/0255831 | A1 * | 12/2004 | Rabovitser et al. | 110/345 |
| 2005/0274308 | A1 * | 12/2005 | Copeland et al. | 110/346 |
| 2006/0081161 | A1 | 4/2006 | Martin et al. | |

FOREIGN PATENT DOCUMENTS

| | | | |
|---|---|---|---|
| EP | 1 348 906 | A1 | 10/2003 |
| EP | 1 647 770 | | 4/2006 |
| JP | S55-6612 | | 1/1980 |
| JP | 2006-105431 | | 4/2006 |
| JP | 2006-234364 | | 9/2006 |

* cited by examiner

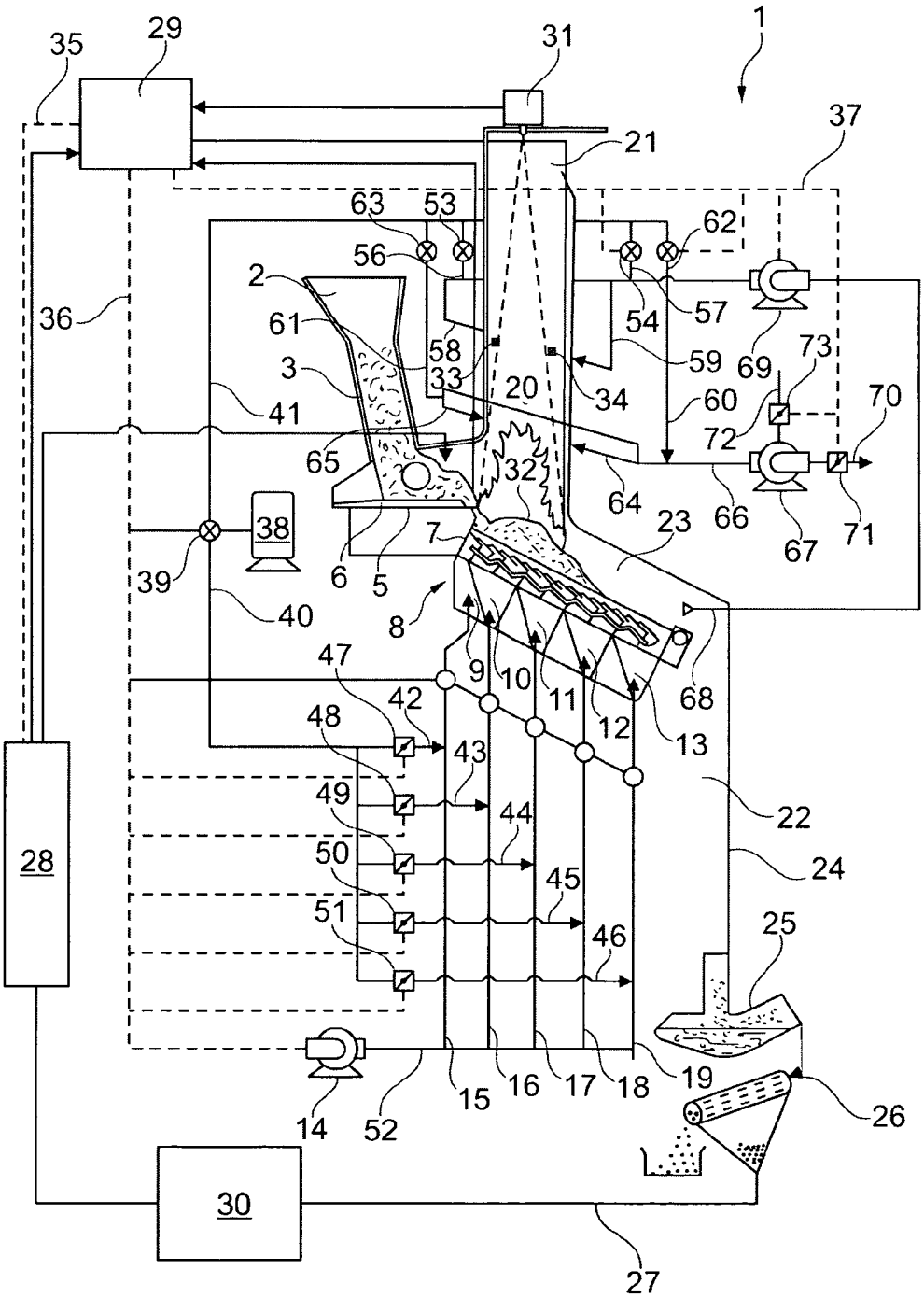
1
2
3
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
56
57
58
59
60
61
62
63
64
65
66
67
68
69
70
71
72
73

INCINERATION PLANT AND METHOD FOR CONTROLLING AN INCINERATION PLANT

CROSS REFERENCE TO RELATED APPLICATIONS

Applicant claims priority under 35 U.S.C. §119 of Russian Application No. 2008121732 filed on May 29, 2008.

The invention relates to an incineration plant with a furnace, a device for feeding back incineration residues into the furnace, a device for measuring at least one parameter of the incineration, and devices for controlling the incineration. Moreover, the invention relates to a method for controlling an incineration plant.

Such incineration plants are prevalent and are primarily used as large firing installations for the incineration of rubbish and waste materials. Different incineration parameters are measured and controlled in order to ensure optimal incineration and to minimise the generation of noxious gases. It is important that the materials to be incinerated, in particular the rubbish, are burnt out as completely as possible and that minimal pollutants are contained in the flue gas.

It is also known from the teaching to feed incompletely burnt out incineration residues back into a grate firing. It is especially important in the feeding back of incineration residues to ensure particularly that the incineration parameters are adjusted optimally during the feedback process in order to not negatively affect the incineration through the fed back materials and also to achieve the best possible incineration of the materials to be incinerated.

The object of the invention is to further develop an incineration plant in such a manner that optimal incineration is achieved with minimal emission of pollutants.

This object is solved with an incineration plant of the generic kind that has a device that controls the amount of the incineration residues that are fed back.

Such a device allows for the amount of the incineration residues fed back to be varied in such a manner that that variable amount of fed back incineration residue affects the incineration.

While heretofore all incompletely burnt out incineration residues were fed back into the incinerator and the added combustion air and the devices for controlling the incineration were intended to maintain an incineration that was as optimal as possible, the incineration plant according to the invention permits control of the incineration through the directed variation of the amount of incineration residues that are fed back.

In this manner, by reducing the amount of incineration residues that are fed back, it is, for example, thus possible to reduce the size of the flame during incineration that is too intense. By the same token, by reducing the amount of incineration residues that are fed back, the firing can be intensified in order to obtain a more favourable burnout.

A particularly advantageous embodiment variant of the incineration plant provides that the firing is designed as grate firing, in particular with a reverse-acting grate, and the incineration residues are loaded on the start of the grate.

In particular, it is also possible to control the incineration residues that are fed back at the location in question by means of a device. In this manner, it is possible in the instance of grate firing to, for example, to effect the feeding back of the incineration residues at the beginning, middle, or end of the grate. Moreover, it is common for a plurality of grates arranged one after the other to be used on which different firing performance develops. With one device, the individual grate with especially high firing performance can be selected in order to introduce the fed back incineration residues that are there.

The feeding back of the incineration residues is thus used as an additional device for controlling the incineration.

In order to feed the incineration residues in defined amounts to the firing, it is suggested that the device for feeding back the incineration residues has a driven conveyor. Such a conveyor can be a screw conveyor, for example. Pneumatic conveyors are suitable for such purposes as well.

A special embodiment variant provides that the incineration residues are fed back with a portion of the primary or secondary air. In this instance, a pneumatic conveyor feeds incineration residues and combustion air to the firing.

A particularly advantageous embodiment variant provides that the device for the measuring of parameters of the incineration has a camera. A camera makes it possible to determine at precise locations how the incineration is proceeding in the feed region and especially at different locations of the incinerator grate. By means of an image processing system, a fully-automated controlled feeding back of the incineration residues can be effected. More particularly, automatisation makes it possible to control or regulate the feeding back according to feed location (location), fed volume flow rate (amount), and feed duration (time) using a correspondingly measured parameter.

A simple embodiment variant provides that the feeding back of the incineration residues is controlled. It is, however, advantageous if the device controlling the feeding back of the incineration residues has a control unit. Such a control unit works together with a measuring and actuating device, in order to adjust precisely the amount to be fed back. The measuring device can have the camera and/or additional devices for measuring incineration parameters, while the actuating device controls the motor of a driven conveyor for feeding back the incineration residues, for example.

It is advantageous if a plurality of different incineration parameters is calculated in order to supply a calculated value to the control unit. In this manner, for example, an intensified incineration on a region of the grate can lead to an increased volume flow rate, while a measurement indicating an increased value of a carbon monoxide in the flue gas can reduce the amount, and even stop the back feeding, upon reaching a special limit value.

An increased flue gas temperature, for example, can increase the speed of the motor of the incineration residues that are fed back, while a decrease in the temperature in the flue gas can lead to a reduction in the amount of the incineration residues that are fed back.

In so far as the incineration plant has a control unit, it is suggested that the device for measuring the incineration affect the control unit.

While a simple embodiment of the incineration plant provides for a linear regulation or regulation by means of a cam disc between the measured incineration parameters and the amount fed back, an optimised incineration plant has a proportional control unit, a proportional plus integral control unit or a proportional plus floating plus derivative control unit.

If few poorly burned incineration residues can be fed back into the firing because the firing parameters do not permit a feeding back, poorly burned incineration residues also reach the remaining incineration residues. In contrast thereto, an embodiment variant provides in such instances for initially storing the poorly burnt incineration residues in a buffer storage until said incineration residues can be fed to the firing plant again. In this case, the incineration plant has a buffer storage for incineration residues that are to be re-fed.

The object addressed by the invention is also solved by a method for controlling an incineration plant in which incineration residues can be fed back into the incineration plant and incineration parameters are measured, the volume flow rate of the fed back incineration residues being adjusted as a function of at least one measured parameter of the incineration.

It is advantageous if the volume flow rate is regulated.

Particularly favourable incineration results can be achieved if a plurality of incineration parameters are measured and calculated for the regulation of the volume flow rate. A computer can ensure that different incineration parameters can differently affect the volume flow rate to be fed back.

A simple method provides that the incineration plant is set for a combustible heating value and an increased burning intensity is counteracted with an increased volume flow rate of the feeding back. Particularly in waste incineration plants, the combustible heating value varies and it is therefore very advantageous if it is possible to temporally or regionally or locationally counteract a firing intensity that is too great with an increased feeding back of incineration residues.

One embodiment variant provides for measuring at least one parameter correlating to the burn out, the volume flow rate of the feeding back being increased upon reduced burn out. As a result, an especially large amount of incineration residues is fed back into the incineration plant upon particularly poor burn out of the combustibles.

One embodiment according to the invention is shown in the drawing and is explained in greater detail in the following.

It shows in

FIG. 1 a schematic structure of a waste incineration plant with a reverse-acting grate and different possibilities of a primary combustion gas control and a secondary combustion gas control as well as an apparatus that affects the amount of the incineration residues that are fed back.

The firing plant 1 shown in FIG. 1 has a feeding hopper 2 with an attached feeding chute 3 for the feeding of the combustibles 4 on a feed table 5. Charging pistons 6 are provided in a back-and-forth moveable manner on the feed table 5 in order to feed the combustibles 4 emerging from the feeding chute 3 onto a firing grate 7 on which the combustion of the combustibles 4 occurs.

It is immaterial for the combustion whether the grate concerned is inclined or lies horizontally. The drawing shows a reverse-acting grate. The method can, however, also be used in a fluidized-bed combustion plant.

Arranged beneath the incinerator grate 7 is an apparatus, which is designated by 8 in its entirety, for feeding primary combustion gas and that may comprise a plurality of chambers 9 to 13 to which primary combustion gas, in the form of ambient air, is supplied by means of a blower 14 via lines 15 to 19.

Owing to the arrangement of the chambers 9 to 13, the firing grate is divided into a plurality of undergrate air zones so that the primary combustion gas can be adjusted differently corresponding to the requirements on the firing grate 7. These undergrate air zones are divided up according to the width of the firing grate in the transverse direction as well, so that the primary combustion gas can be added in a controlled manner corresponding to the locational conditions at different locations.

The furnace 20 is located above the firing grate 7, which furnace 20 transitions into the waste gas flue 21. Additional units not shown here are attached to the waste gas flue 21 such as, for example, a withdrawal boiler and a waste gas purification system.

The incineration of the combustible 4 takes places primarily on the more forward part of the firing grate 7 above which the waste gas flue 21 is situated. In this area, the majority of the primary combustion gas is supplied through the chambers 9 to 11. The already burnt out combustibles, that is to say slag, is found on the rearward part of the firing grate 7 and primary combustion gas is also supplied into this area by means of the chambers 12 and 13 substantially for cooling the slag 22 only.

Therefore, the waste gas in the rearward region 23 of the furnace 20 has an oxygen content greater than that of the more forward region. The waste gas accumulating in the rearward region 23 is therefore used as internal recirculation gas for the secondary incineration.

The burnt out portions of the combustibles 4 fall as slag 22 into a slag discharge 24 at the end of the firing grate 7.

The slag 22 falls from the slag discharge 24 together with the remaining incineration residues into the wet slag remover 25 from which it is fed to a separation component 26. The unsintered or unmelted residual slag is then admixed with the combustible via a line 27 and a conveyor 28 that conveys it into the feeding region by way of the feed table 5, subsequent to which it thus arrives on the firing grate 7 again.

The separation component designated with 26 shows in only a schematic way the separation of the grate ash into scrap iron, completely sintered inert granulate or melted incineration residues.

In one waste incineration plant, for example, one ton of refuse with an ash content of 22 kg can result in 7320 kg of grate ash on the end of the grate. This 320 kg of grate ash is separated, by means of the separation process indicated by 26, into 30 kg scrap iron, 190 kg completely sintered inert granulate, and 100 kg unmelted or unsintered incineration residues. A portion of the unsintered or unmelted incineration residues can also be added to the boiler ash and the filter dust. This fraction is then re-fed to incineration by means of the line 27 and the conveyor 28. In one practical example, 110 kg of the 320 kg of grate ash are fed again to the grate firing.

In order to not also negatively affect the firing by introducing this portion of the slag, a complicated control and computer unit 29 is used. This unit 29 calculates measured values from measuring devices and generates control signals in order to regulate not only blowers that directly affect the firing, but also to regulate the conveyor device 28 that varies the volume flow rate that is fed back.

The amount of slag 22 produced per unit of time, as a rule, thus no longer corresponds to the amount of slag fed per unit of time. Therefore, a buffer storage unit 30 is arranged in front of the conveyor 28.

Instead of or in addition to the buffer storage unit 3, the separation process can be regulated in such a manner that based on the incineration state, more or less unsintered or unmelted incineration residues are fed back to the grate firing. For example, if incineration is poor, the separation process can be conducted in such a manner that a greater proportion of unsintered or unmelted incineration residues arrive with the completely sintered inert granulate, while during particularly favourable incineration conditions the qualitative requirements of a completely sintered inert granulate are increased in such a manner that a greater amount of unsintered or unmelted incineration residues results.

A thermography camera 31 observes through the flue gases the surface of the combustion bed 32, and the values obtained thereby are transferred to the central computer unit that does not have a control unit 29. A plurality of sensors, which are designated with 33 and 34, are arranged above the surface of the combustion bed layer 32 and serve to measure the $O_2$—, CO—, and $CO_2$-content in the waste gas above the combustion bed 32, that is to say in the primary incineration zone.

To increase clarity, all lines that serve to distribute the flow media or the collected data are represented with unbroken lines, while lines that transmit the regulation commands are represented with dashed lines.

The control and computer unit receives measured values about the current conveyed amount of fed-back incineration residues from the thermography camera 31, from sensors 33 and 34, and from the conveying device 28. These data are calculated in order to regulate the conveyer 28 by means of line 35, to regulate the primary air through a line 36, and the regulation of the secondary air by means of a line 37.

Pure oxygen is conveyed from an air fractionation arrangement 38 by means of a conveyer and distribution apparatus 39 into, on the one hand, a line 40 for admixing into primary combustion gas and, on the other hand, into a line 41 for admixing into secondary combustion gas. Branch lines 42 to 46 are supplied by the line 40, which branch lines are controlled by valves 47 to 51 that themselves likewise are affected by the control and computer unit 29.

The supply lines 42 to 46 lead into branch lines 15 to 19 that branch from the line 52 for ambient air and lead to the individual undergrate air chambers 9 to 13.

The second line 41 that arises from the conveyer and distribution apparatus 39 leads to the secondary incineration nozzles 58, 59 by way of control valves 53, 54 and lines 56, 57 and is the means by which the internal recirculation gas is introduced into the combustion chamber. The secondary incineration nozzles 64 and 65 can be supplied oxygen by means of the branch lines 60, 61 that are controlled by control valves 62, 63, which secondary incineration nozzles 64 and 65 are supplied secondary combustion gas by means of the blower 67 by way of line 66. This can comprise either pure ambient air or a mixture of ambient air with purified waste gas.

The recirculation gas is directed to the secondary incineration nozzles 58, 59, which are arranged on opposite positions on the waste gas flue 21, by way of a suction line 68 that leads to the suction blower 69

The secondary incineration nozzles 64 and 65 are distributed in greater numbers on the periphery of the waste gas flue 21. In that location, secondary combustion gas in the form of ambient air can be introduced, which ambient air is conveyed by means of the blower 67. An intake line 70 is provided therefor, a control organ 71 being permitted to adjust the amount of ambient air. Another line 72 that is connected to the blower 67 and is controlled by a control organ 73, serves to draw in purified waste gas recirculation gas that is admixed with the ambient air. This purified waste gas recirculation gas is drawn in subsequent to the waste gas flowing through the waste gas purification apparatus and has an oxygen content that is less than that of the internal recirculation gas. This waste gas circulation gas serves first and foremost to generate turbulence if the waste gas amount in the waste gas flue 21 is too little in order to generate sufficient turbulence to improve the burning in the secondary area.

The control and computer unit 29 thus controls the entire plant and it consists of different control apparatuses in order to affect the individual actuating devices. For example, while a carbon monoxide limit value being exceeded in the waste gas in the control and computer unit 29 leads to a signal being transmitted to the conveyor device 28, with which signal the conveyor device 28 is stopped, particularly high temperatures that are detected by the thermography camera 31 in turn lead to an increase in the performance of the conveyor device in order to increase the amount of slag 22 fed back on the grate.

In the exemplary embodiment, it is shown that the fed-back slag is fed back on the feed table 5. An embodiment variant that is not shown provides that given a plurality of grates arranged side by side, a special grate can also be selected for the feeding back and, optionally, it also being possible to select from different grates during the carrying out of the method in order to regulate individually the combustion operation on different grates by feeding slag back.

The invention claimed is:

1. An incineration plant comprising:

a) a furnace for incinerating combustible materials;

b) a feeding hopper with an attached feeding chute for feeding the combustible materials onto a firing grate via a feed table;

c) a thermography camera configured to measure a temperature of a combustion bed of the furnace;

d) a conveyor device configured to feed incineration residues back to the combustible materials;

e) a buffer storage for the incineration residues that are to be fed back to the combustible materials;

f) a plurality of sensors configured to measure a gas content above said combustion bed; and g) a central computer unit coupled to said thermography camera, to said conveyor device and to said plurality of sensors, said central computer unit configured to:

receive measured values from said thermography camera, from said conveyor device and from said plurality of sensors, said measured values corresponding to a conveyed amount of incineration residues fed back by said conveyor device;

generate a control signal for regulating a volume flow rate of the incineration residues fed by said conveyor device based upon said measured values and independently of a rate of the feeding of the combustible materials onto said firing grate via said feed table;

generate a control signal for regulating a flow rate of primary combustion air based upon said measured values; and generate a control signal for regulating a flow rate of secondary combustion air based upon said measured values.

2. The incineration plant as specified in claim 1, wherein a firing is designed as grate firing and the incineration residues are loaded on a start of the firing grate.

3. The incineration plant as specified in claim 1, further comprising a device to control the incineration residues at a location where they are fed back.

4. The incineration plant as specified in claim 1, wherein the conveyor device controlling the feeding back of the incineration residues has a control unit.

5. The incineration plant as specified in claim 4, wherein said measured values affect the control unit.

6. The incineration plant as specified in claim 4, wherein the control unit is a proportional controller.

7. The incineration plant as specified in claim 4, wherein the control unit is a proportional plus integral control unit.

8. A method for controlling an incineration process in an incineration plant, the method comprising the steps of:

a) providing a furnace for incinerating combustible materials;

b) feeding the combustible materials from a feeding hopper with an attached feeding chute onto a firing grate of the furnace via a feed table;

c) measuring a temperature of a combustion bed of the furnace with a thermography camera;

d) feeding incineration residues back to the combustible materials via a conveyor device;

e) providing a buffer storage for the incineration residues that are to be fed back to the combustible materials;

f) measuring a gas content above the combustion bed with a plurality of sensors;

g) coupling a central computer unit to the thermography camera, to the conveyor device and to the plurality of sensors; and h) configuring the central computer unit to receive measured values from the thermography camera, from the conveyor device and from the plurality of sensors, the measured values corresponding to a conveyed amount of incineration residues fed back by the conveyor device; wherein the central computer:

generates a control signal for regulating a volume flow rate of the incineration residues fed by the conveyor device based upon the measured values and independently of a rate of the feeding of the combustible materials onto the firing grate via the feed table;

generates a control signal for regulating a flow rate of primary combustion air based upon the measured values; and generates a control signal for regulating a flow rate of secondary combustion air based upon the measured values.

9. The method as specified in claim 8, wherein a plurality of incineration parameters are measured by different devices and calculated for the regulation of the volume flow rate.

10. The method as specified in claim 8, wherein the incineration plant is set for a combustible heating value and an increased burning intensity is counteracted with an increased volume flow rate of the feeding back.

11. The method as specified in claim 8, wherein at least one parameter correlating to the burn out is measured and the volume flow rate of the feeding back being increased upon reduced burn out.

* * * * *